US006601782B1

(12) United States Patent
Sandholm et al.

(10) Patent No.: US 6,601,782 B1
(45) Date of Patent: Aug. 5, 2003

(54) DISPOSABLE SPRAY NOZZLE ASSEMBLY

(75) Inventors: Albert E. Sandholm, Brooklyn, CT (US); Richard W. Clemens, Somers, CT (US); John H Hunter, Moon Township, PA (US)

(73) Assignee: Plas-Pak Industries, Inc., Norwich, CT (US)

( * ) Notice: Subject to any disclaimer, the term of this patent is extended or adjusted under 35 U.S.C. 154(b) by 0 days.

(21) Appl. No.: 10/328,378

(22) Filed: Dec. 23, 2002

(51) Int. Cl.[7] ..... B05B 7/06
(52) U.S. Cl. ..... 239/427; 239/600
(58) Field of Search ..... 239/600, 104, 239/413, 427, 488; 222/459, 45.6

(56) References Cited

U.S. PATENT DOCUMENTS

| | | | | |
|---|---|---|---|---|
| 1,292,567 | A | | 1/1919 | Beckwith |
| 2,351,787 | A | | 6/1944 | Smith |
| 2,826,451 | A | | 3/1958 | Sedlacsik |
| 3,015,449 | A | | 1/1962 | Meyer |
| 3,373,941 | A | | 3/1968 | Davis, Sr. |
| 3,468,487 | A | | 9/1969 | Warren |
| 3,515,130 | A | | 6/1970 | Tsujino |
| 3,896,996 | A | | 7/1975 | Roest et al. |
| 3,904,126 | A | | 9/1975 | Allard |
| 3,949,970 | A | | 4/1976 | ter Braak |
| 4,022,383 | A | | 5/1977 | Zeley |
| 4,171,096 | A | | 10/1979 | Welsh et al. |
| 4,218,014 | A | | 8/1980 | Tracy |
| 4,302,550 | A | | 11/1981 | Pisaric et al. |
| 4,560,377 | A | | 12/1985 | Geat et al. |
| 4,592,509 | A | | 6/1986 | Moss |
| 4,846,405 | A | | 7/1989 | Zimmermann |
| 5,102,484 | A | | 4/1992 | Allen et al. |
| 5,249,709 | A | * | 10/1993 | Duckworth et al. ..... 222/137 |
| 5,273,533 | A | | 12/1993 | Bonaldo |
| 5,388,764 | A | * | 2/1995 | Moses ..... 239/74 |
| 5,405,083 | A | | 4/1995 | Moses |
| 5,417,372 | A | | 5/1995 | Portugal |
| 5,431,343 | A | | 7/1995 | Kubiak et al. |
| 5,474,536 | A | | 12/1995 | Bonaldo |
| 5,486,676 | A | | 1/1996 | Aleshin |
| 5,512,043 | A | | 4/1996 | Verkaart |
| 5,535,922 | A | | 7/1996 | Maziarz |
| 5,536,531 | A | | 7/1996 | Owen et al. |
| 5,725,499 | A | | 3/1998 | Silverstein et al. |
| 5,797,546 | A | | 8/1998 | Reed et al. |
| 5,810,254 | A | | 9/1998 | Kropfield |
| 5,984,889 | A | | 11/1999 | Christ et al. |
| 6,062,492 | A | | 5/2000 | Tudor et al. |
| 6,102,308 | A | | 8/2000 | Steingass et al. |
| 6,131,823 | A | | 10/2000 | Langeman |
| 6,250,567 | B1 | | 6/2001 | Lewis et al. |
| 6,409,098 | B1 | | 6/2002 | Lewis et al. |

OTHER PUBLICATIONS

Condor Duplex Pump Low Pressure Spray Cartridge Gun "Elastomer Specialties, Inc." (no date).

* cited by examiner

*Primary Examiner*—Lisa A. Douglas

(57) ABSTRACT

A disposable synthetic resin spray nozzle assembly for spraying reactive multi-component liquid mixtures includes a static mixer and an air or gas manifold. The static mixer has an elongated mixing tube containing a mixing element, and a liquid dispensing nozzle is formed at the downstream end of the mixing tube. A one-piece manifold has an inner wall which includes a mixer support section sealingly mounted around the static mixer, an air inlet section for receiving an air supply through a conduit, and an air dispensing section which, together with the outer wall of the liquid dispensing nozzle, forms an air dispensing nozzle. The reactive liquid mixture is atomized by air that supplied through the air dispensing nozzle.

20 Claims, 9 Drawing Sheets

DISPOSABLE SPRAY NOZZLE ASSEMBLY

BACKGROUND OF THE INVENTION

The present invention relates to spray nozzle assemblies for use with dual cartridges and, more particularly, to a disposable spray nozzle assembly for use in delivering dual component liquid systems.

Conventional systems for spraying highly reactive dual multiple ratio component materials generally include a dual barrel cartridge unit or other source (e.g., five gallon pails, five fifty-five gallon drums) containing the two components, a disposable static mixing tube which is connected to a reusable air manifold and a reusable air cap which are connected to a supply of pressurized air. Such assemblies are disassembled when the contents of the cartridge have been discharged and/or the static mixer becomes fouled. The static mixer is replaced, the manifold and air cap are cleaned with a solvent, and the system is re-assembled using a new mixing tube with the cleaned air manifold and air cap. The time required for disassembly and re-assembly of the components can be rather costly when viewed as lost production time. It would be useful to develop an economical spray nozzle assembly that could be removed with disposable components from the air supply and replaced more quickly and efficiently than prior known systems.

It is an object of the invention to provide a novel and an economical spray nozzle assembly for use with dual cartridges for mixing and spraying two component liquid systems.

Another object is to provide such an assembly which can be easily and quickly assembled with a cartridge and air supply that can require minimal down time.

A further object is to provide such an assembly that does not require cleaning with solvents.

SUMMARY OF THE INVENTION

It has now been found that the foregoing and related objects may be readily attained in a disposable spray nozzle assembly for coupling to a dual cartridge or other source to mix and spray a dual component mixture comprising a synthetic resin static mixer including an elongated mixing tube with an inlet end portion and an outlet end portion providing a liquid dispensing nozzle having an outer wall, and a mixing element disposed in the mixing tube.

A unitary synthetic resin manifold has a body portion with an upstream end portion, a downstream end portion, and a longitudinal passage therethrough bounded by an inner wall. The upstream end portion extends about and is coupled to the mixer, and the passage has a mixer support section extending about the mixer, an intermediate air inlet section, and an air dispensing section at the downstream end portion extending about and spaced from the dispensing nozzle at the outlet end portion of the mixing tube. The manifold includes a tubular conduit portion extending outwardly from the body portion and providing a passage into the air inlet section of the passage. The outer wall of the mixer nozzle is spaced from the inner wall of the manifold to provide an air passage extending to the downstream end of the manifold.

Preferably, the conduit portion is configured for attachment to air supply means, and there is included air deflection means mounted on the downstream end of the manifold to direct the air flow and discharged mixture.

Desirably the inlet end portion of the mixer provides a mixing chamber with first and second liquid inlets for receiving first and second liquid reactants from an associated dual cartridge. The assembly also includes coupling means for coupling the spray nozzle assembly to a dual cartridge or other like source of reactive materials. Conveniently, the inlet end of the mixing tube is threaded to provide the coupling means for connection to a dual cartridge.

In one embodiment, the mixer support section of the inner wall of the manifold includes a plurality of peripherally extending ribs providing fluid sealing engagement about the static mixer. Alternatively, the mixer support section may be bonded to the mixer.

Although air is generally used as the source of the pressure for spraying the mixture, other gases may be employed. The term "air" as used herein is intended to encompass air as well as other gases.

The air deflection means provides a plurality of air dispensing apertures, and it is rotatably mounted on the manifold. The air dispensing nozzle may include means for atomizing the liquid mixture in a circular spray pattern. In another embodiment, the air deflection means has first and second air dispensing apertures configured for atomizing the liquid mixture in a linear spray pattern.

The spray nozzle assembly is coupled to a dual cartridge or other source of multiple ratio materials connected to the first and second liquid inlets of the mixer for dispensing first and second liquid reactants into the mixing chamber. The twin cartridge has an outlet comprising a partitioned tubular projection and the outlet is coupled to the mixer by a threaded coupling.

DETAILED DESCRIPTION OF THE ILLUSTRATED EMBODIMENT

Figure 1:
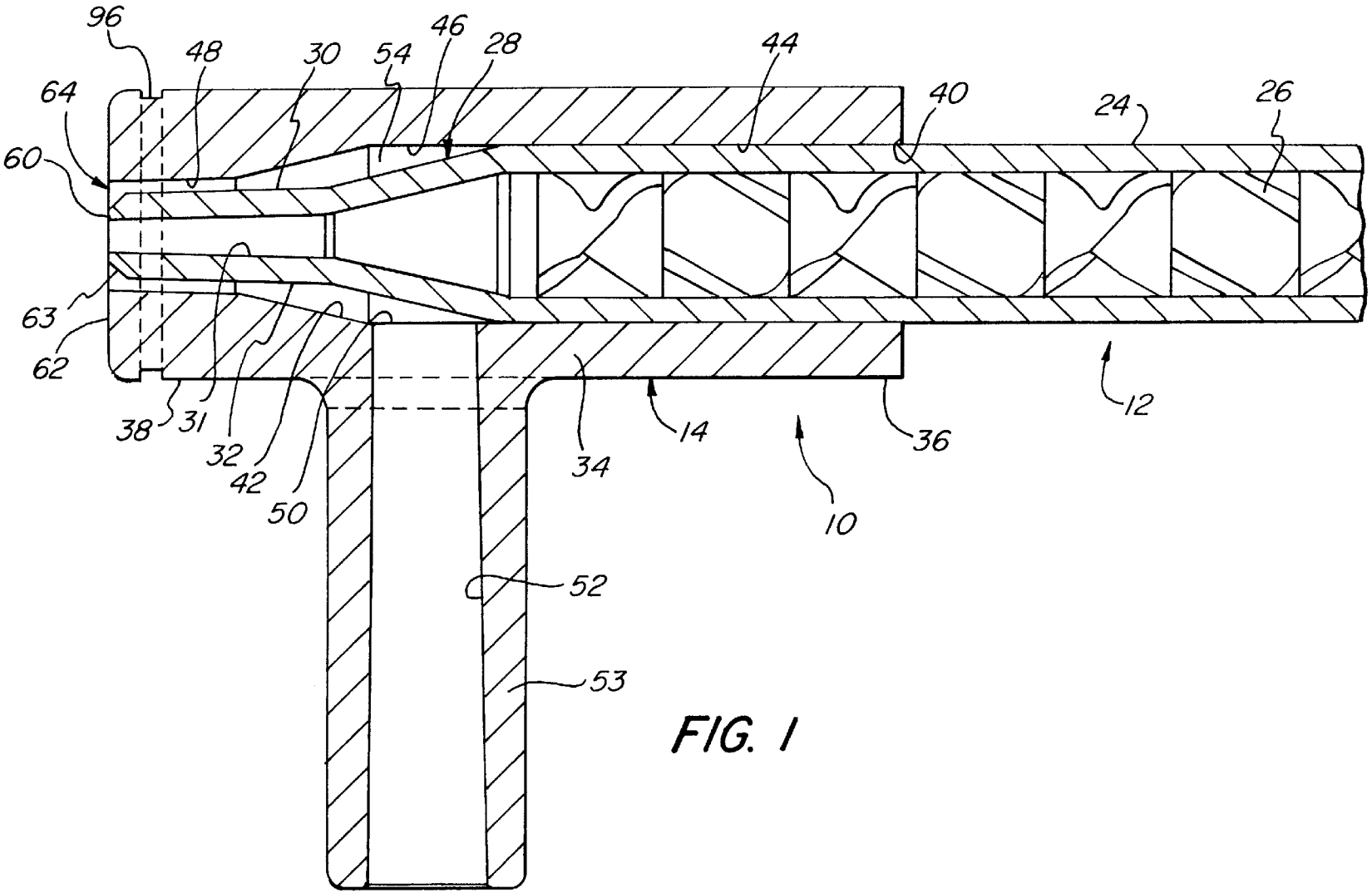
FIG. 1 is a fragmentary, longitudinal sectional view of a first embodiment of a spray nozzle assembly embodying the present invention.
Figure 2:
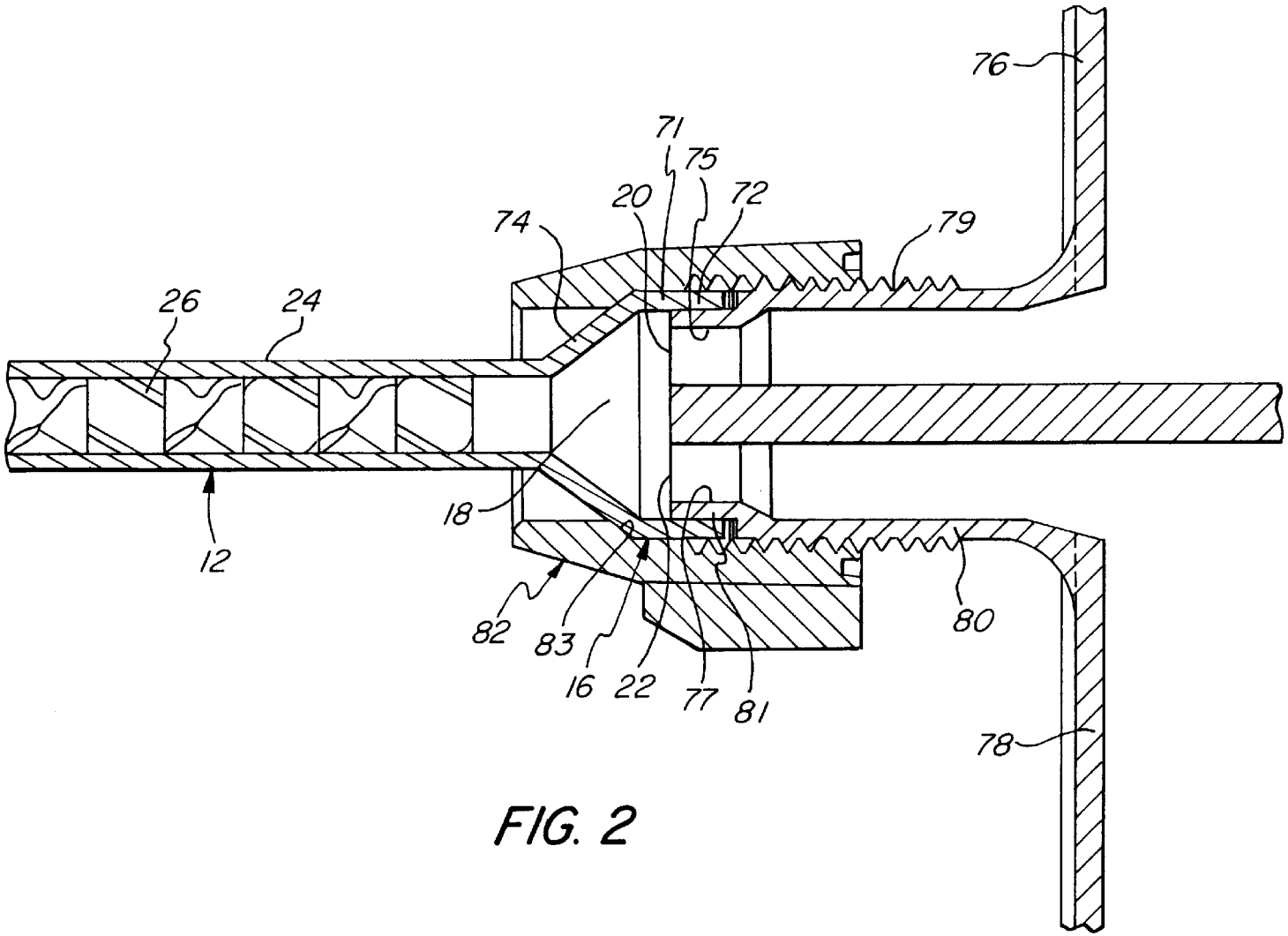
FIG. 2 is a fragmentary, longitudinal sectional view of a spray nozzle assembly showing the connection between the static mixer and a dual cartridge.

Turning first to FIGS. 1 and 2 of the attached drawings, therein illustrated is a spray nozzle assembly embodying the present invention and generally designated by the numeral 10. The spray nozzle assembly 10 includes a static mixer generally designated by the numeral 12 and a manifold generally designated by the numeral 14. The static mixer 12 is formed from a relatively inert synthetic resin material such as polypropylene and polyethylene and has an inlet end 16 with a mixing chamber 18 for receiving a first reactant through a first component inlet 20 and a second reactant through a second component inlet 22. The reactants move downstream from the mixing chamber 18 into the integral, elongated mixing tube 24 in which is disposed baffle elements 26 to thoroughly mix the materials passing therealong. The outlet end 28 of the static mixer 12 is shaped as a dispensing nozzle 30 having an inwardly tapered inner wall 31 and an inwardly tapered outer wall 32.

The manifold 14 is molded as a single piece from a synthetic resin material such as polypropylene, polyethylene, nylon, and other relatively inert resins and it includes a tubular body portion 34 with an upstream end 36 and a downstream end 38. A longitudinal passage 40 extends through the tubular body portion 34 and is defined by the inner wall 42. At the upstream end 36 of the manifold 14, the mixer support section 44 of the inner wall 42 is permanently bonded to the outer wall of the static mixer 12 using an adhesive or suitable welding technique. Alternatively, a permanent snap-lock arrangement (not shown) can be used. The static mixer 12 and manifold 14 preferably are bonded to one another prior to shipping to a customer, thereby facilitating use of the nozzle assembly by the customer.

Downstream from the mixer support section 44, the inner wall 42 of the manifold 14 includes an air inlet section 46 having an inlet 50 which communicates with the passage 52 in the tubular air conduit 53 which is configured for quick attachment to an air supply hose (not shown). The tapered portion of the dispensing nozzle 30 is positioned within and spaced from the inner wall in the air inlet section 46 of the manifold 14 to provide an annular plenum chamber 54 defined by the air inlet section 46 and air dispensing section 48 of the inner wall 42 in combination with the tapered outer wall 32 of the dispensing nozzle 30.

The downstream end of the dispensing nozzle 30 is centered within the air dispensing section 48 of the manifold inner wall 42. In the embodiment shown in FIG. 1, the downstream edge of the outlet tip 60 of the dispensing nozzle 30 is aligned with the downstream tip 62 of the manifold 14. An annular air outlet nozzle 64 is formed between the outer wall 63 of the outlet tip 60 and the downstream end of the air dispensing section 48 of the inner wall 42.

The walls of the mixing chamber 18 include a tubular inlet section 71 with an inlet end 72 and threaded on its outer surface, and an inwardly tapering mixing section 74 to facilitate mixing and to channel the liquid mixture into the integral mixing tube 24. The first component inlet 20 of the static mixer 12 is connected to a discharge tip 75 of a first barrel 76 of a dual cartridge. The second component inlet 22 is connected to a discharge tip 77 for the second barrel 78 of the dual cartridge. Discharge tips 75 and 77 are provided by annular portions of a cylindrical projection 79 with a diametrical partition. The upstream end 80 of the divided cylindrical projection 79 is cooperatively dimensioned with the inlet end 16 of the static mixer 12 and is externally threaded. The downstream end 81 of the cylindrical projection 79 is not threaded and has an inwardly stepped outer wall which fits within the inlet end 16 of the static mixer 12 in a fluid tight arrangement.

To attach the cylindrical projection 79 to the inlet end 16 of the static mixer 12, the inlet end 16 is placed over the downstream end 81 of the cylindrical projection 79 and a retaining nut 82 is placed over the outlet end of the static mixer 12 and is moved along the static mixer 12 in an upstream direction until it reaches the threaded portion of the mixing chamber inlet end 72. The retaining nut 82 is then threaded onto both the inlet end 72 of the static mixer 12 and the upstream end 80 of the cylindrical projection 79 until the tapered inner wall 83 of the retaining nut 82 abuts the outer surface of the tapered side walls 74 of the mixing chamber 18. This arrangement provides for quick attachment and removal of the static mixer 12 and prevents leaking of the liquid reactants during use. In another embodiment, the static mixer can be internally threaded to couple with the cartridge directly.

Figure 3:
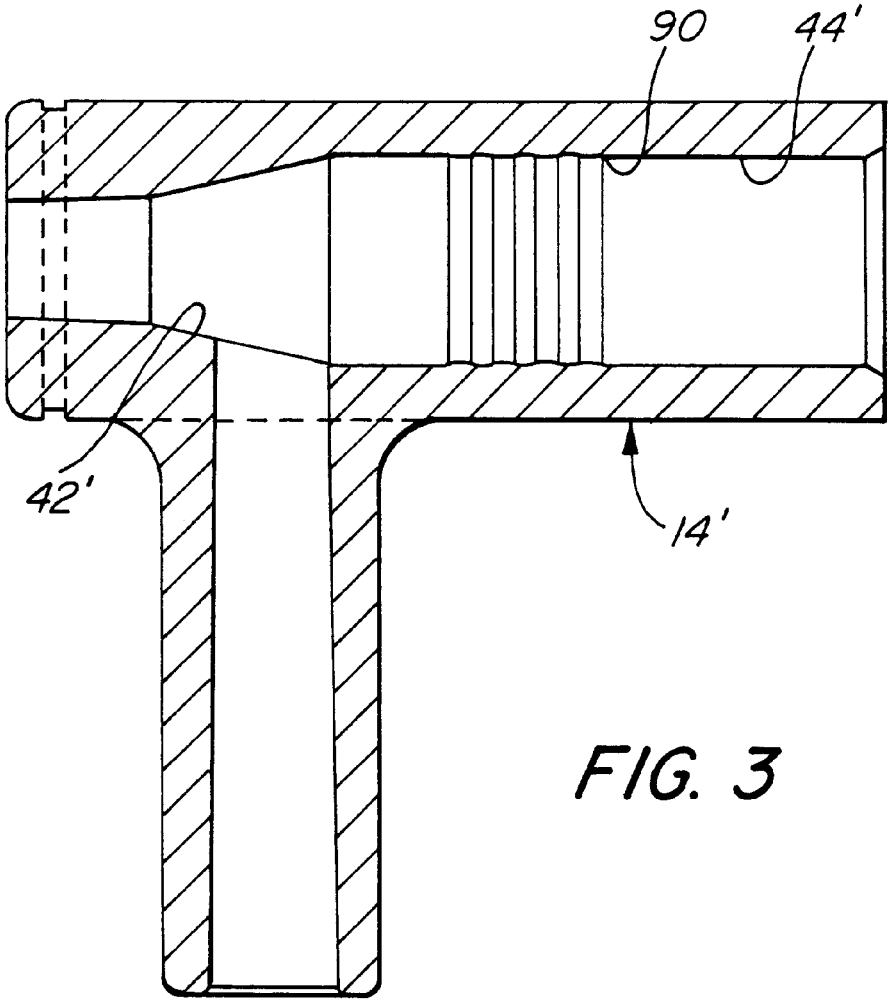
FIG. 3 is a longitudinal elevational view of a manifold having internal sealing ribs.

FIG. 3 shows another embodiment of a manifold 14' which has a plurality of ribs 90 on the mixer support section 44' of the inner wall 42'. These ribs 90 are compressed during assembly which facilitate firm engagement of the manifold 14' and the static mixer 12 in a fluid tight assembly.

Figure 4:
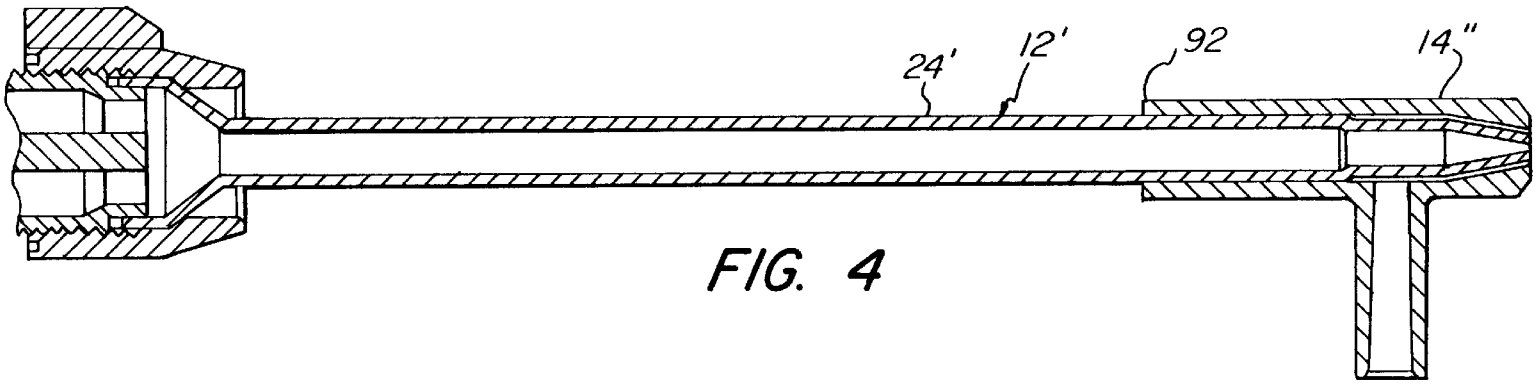
FIG. 4 is a longitudinal sectional view of a spray nozzle assembly with a static mixer having a manifold alignment rib.

FIG. 4 shows an embodiment of the static mixer 12' in which the mixing tube 24' has an annular alignment projection 92 against which the manifold 14" is positioned. The projection 92 facilitates rapid positioning of the manifold 14" about the static mixer 12'.

Figure 5:
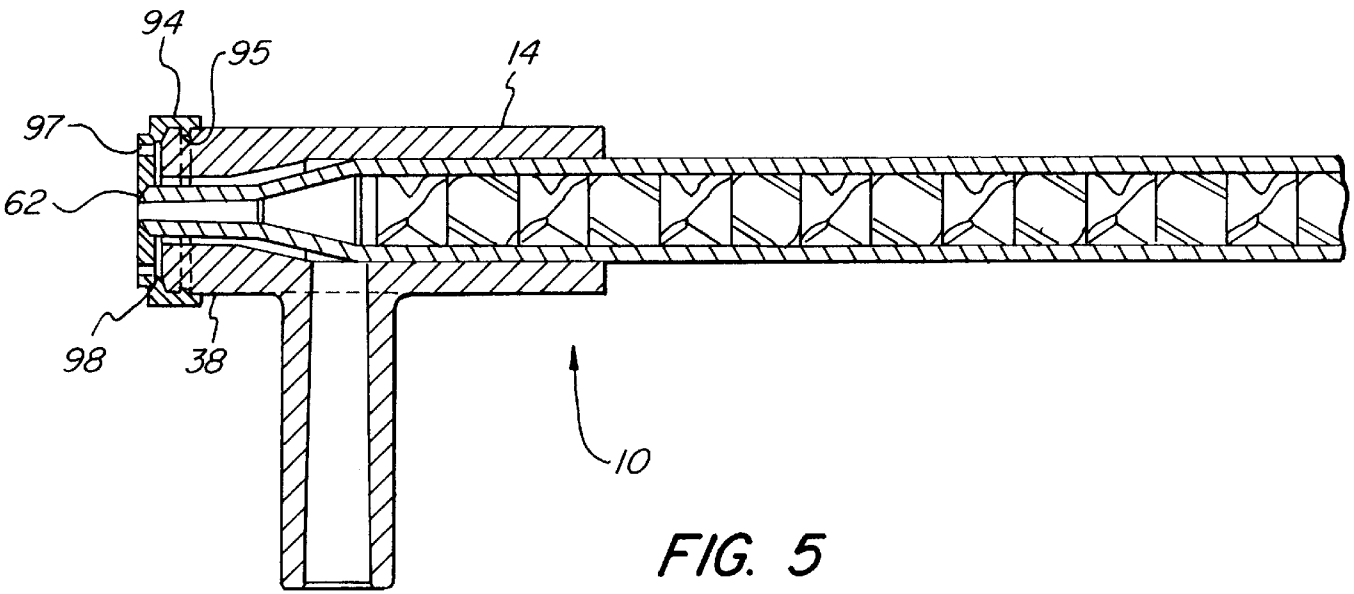
FIG. 5 is a longitudinal sectional view of the spray nozzle assembly showing an air deflector mounted thereon.
Figure 6:
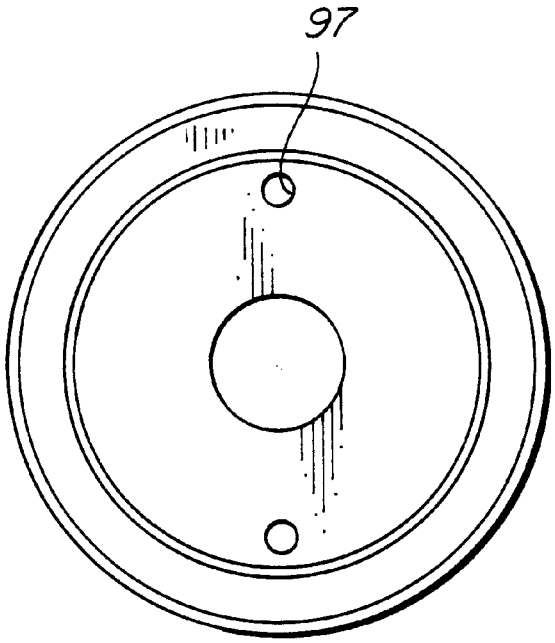
FIG. 6 is a front view of the air deflector shown in FIG. 5 drawn to an enlarged scale.
Figure 7:
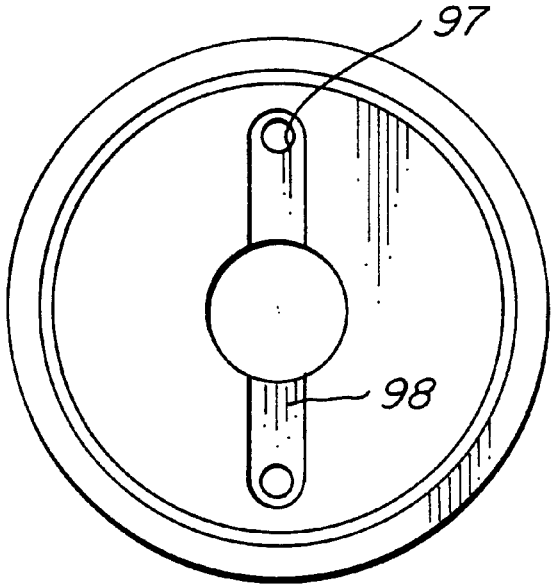
FIG. 7 is a rear view of the air deflector shown in FIG. 5.

Referring now to FIGS. 5–7, the spray nozzle assembly 10 is shown with a first embodiment of a circular air deflector 94 rotatably mounted thereon. The air deflector 94 is made of a synthetic resin material such as polypropylene and polyethylene and has an annular rib 95 on its inner wall that snaps into the annular groove 96, most clearly shown in FIG. 1, on the downstream end 38 of the manifold 14. The air deflector 94 has a plurality of air apertures 97 through which pressurized air is discharged to atomize the liquid mixture discharged from dispensing nozzle 30 of the static mixer. As shown in FIGS. 5 and 7, the rear side of the air deflector 94 includes radially extending air channels 98 to direct air from the air chamber 54 within the manifold 14 through the apertures 97. The position of the apertures 97 in the assembly can be changed by rotating the air deflector 94. In the embodiment shown in FIG. 5, the downstream edge of the air deflector 94 is aligned with the downstream tip 62 of the manifold 14.

Figure 8:
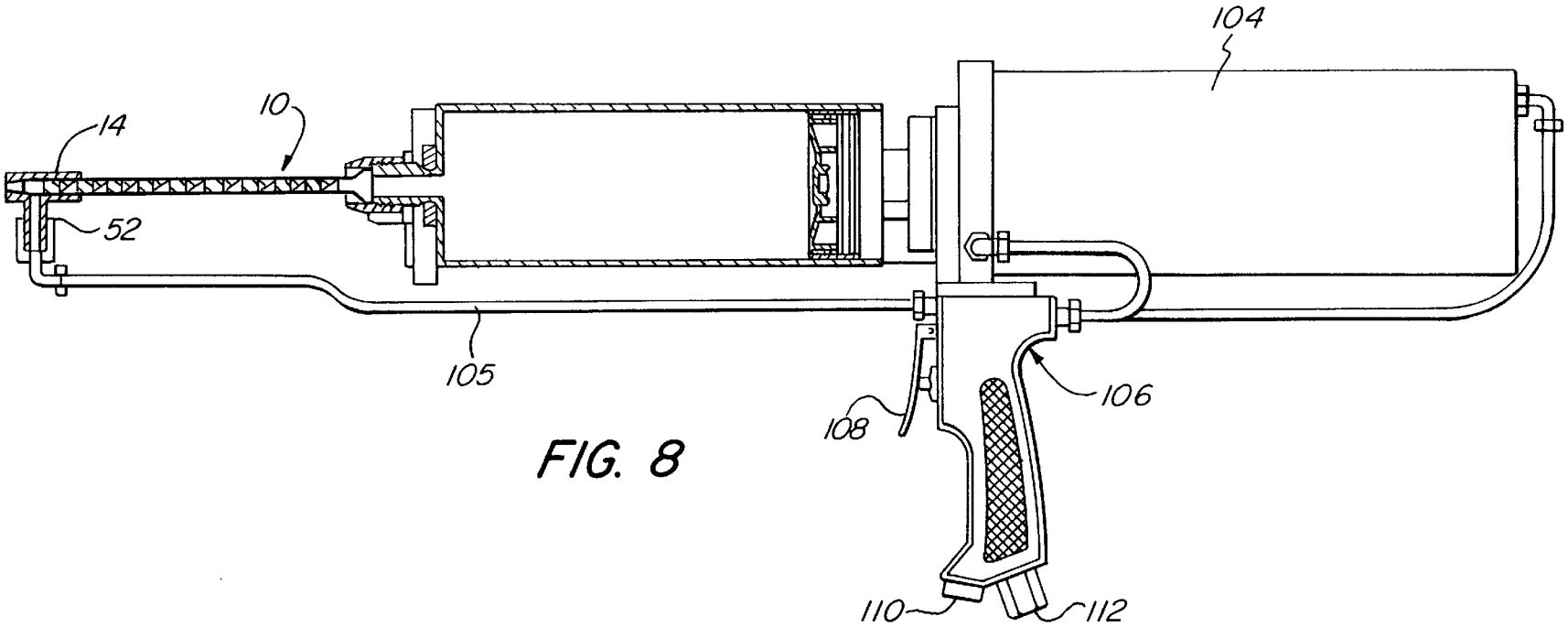
FIG. 8 is a side elevational view of a spray gun with the spray nozzle assembly mounted thereon, the spray nozzle assembly and twin cartridges being shown in section.
Figure 9:
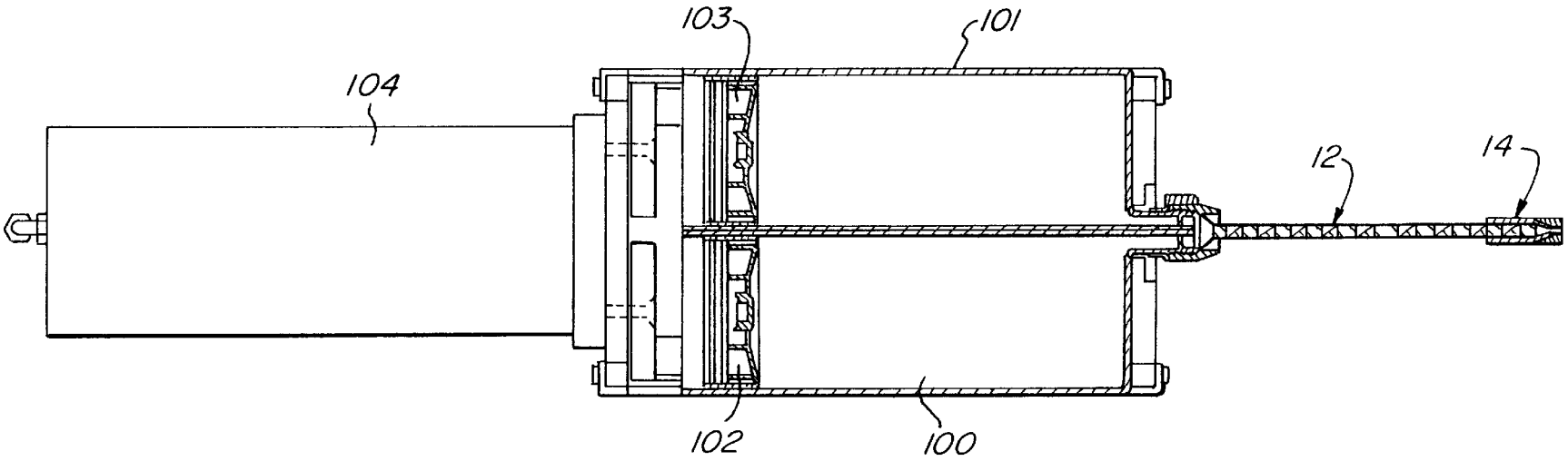
FIG. 9 is a top plan view of the spray gun in FIG. 8 with the spray nozzle assembly and twin cartridges being shown in sectional view.

FIGS. 8 and 9 show the spray nozzle assembly coupled to a dual cartridge unit 100, 101 having two barrels for proportionating and delivering a two component system there through. In the barrels 100, 101 are pistons 102, 103 which are pushed forward by the rods 104. The movement of the rods 104 and the rate of air supply through line 105 into the air passage 52 are controlled by the gun 106 which has a two portion trigger 108, a pressure regulator 110, and an air inlet 112. A partial squeeze of the trigger 108 to the first position sends air through passage 52 into the manifold 14. A full squeeze to the second position activates the rods 104 to push the reactants through discharge lines 75, 77. Power for operation of the spray gun 106 can be pneumatic, electric or manual.

Figure 10:
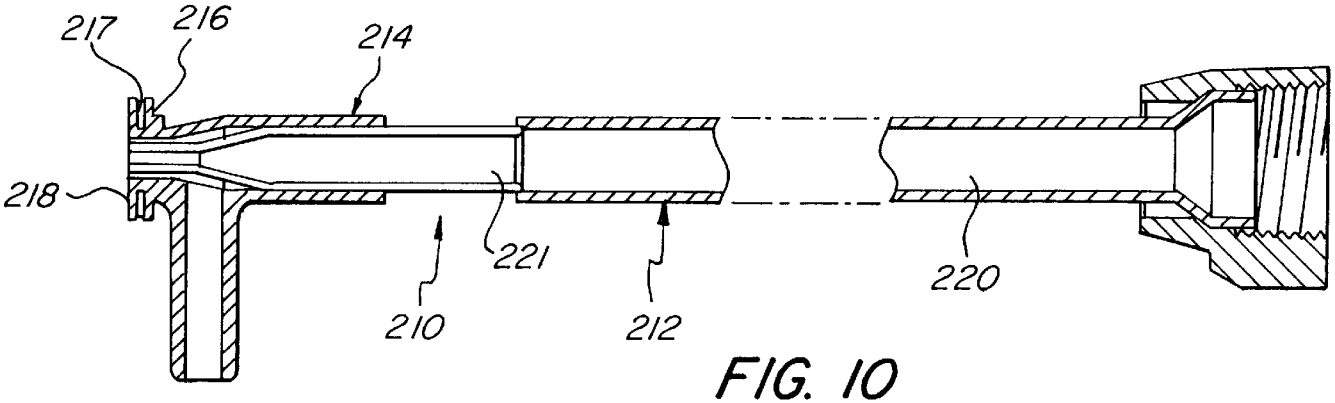
FIG. 10 is a fragmentary longitudinal sectional view of another embodiment of the spray nozzle assembly.
Figure 11:
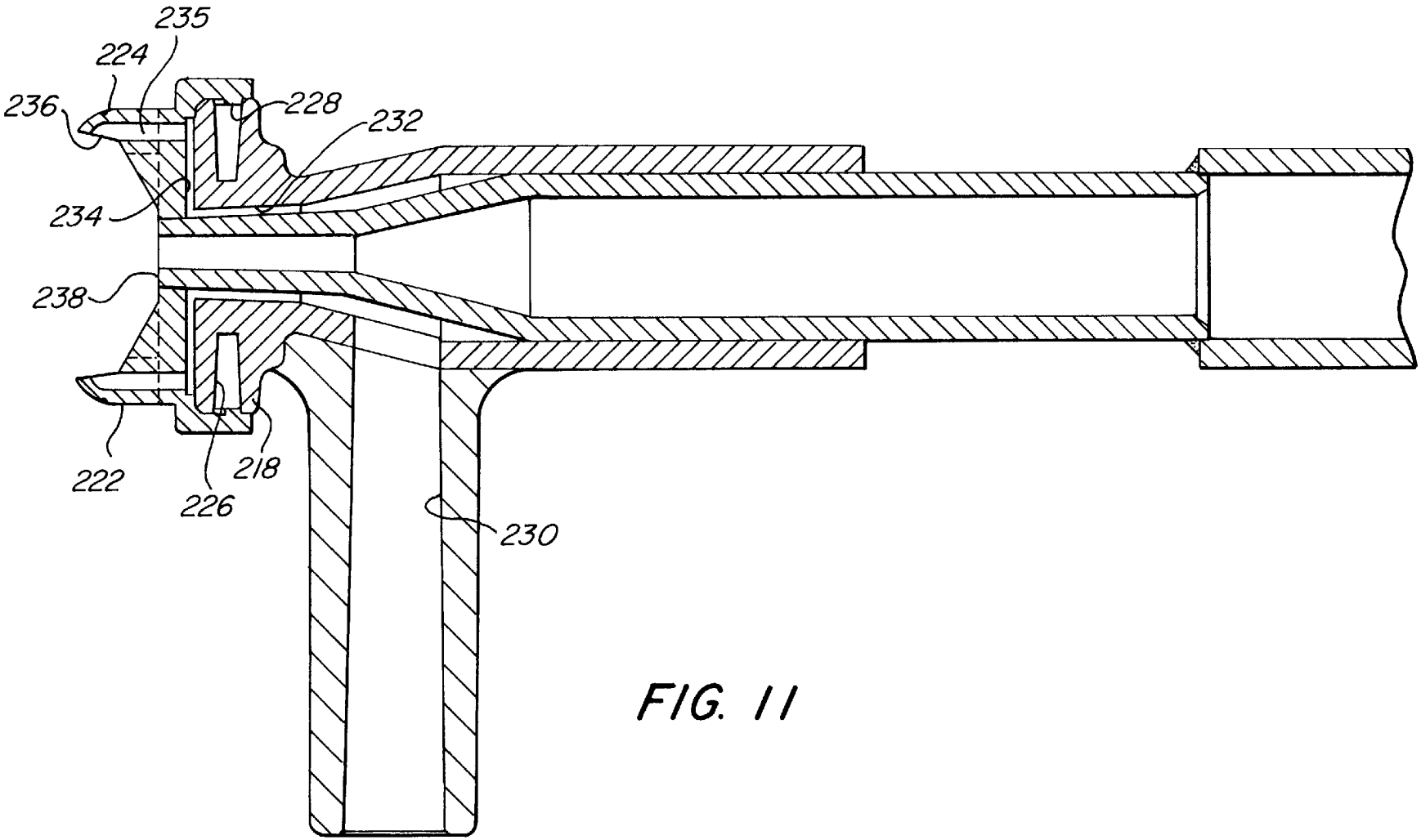
FIG. 11 is a longitudinal sectional view of the spray nozzle assembly of FIG. 10 with another type of air deflector mounted thereon.
Figure 12:
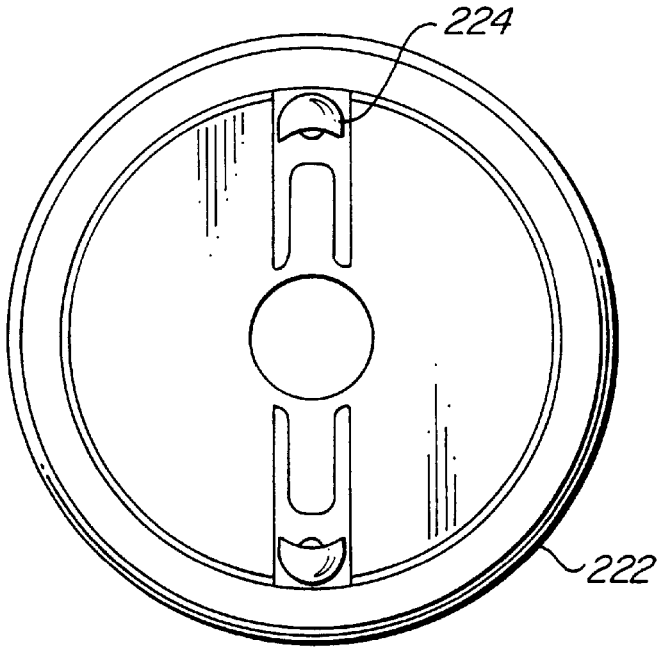
FIG. 12 is a front view of the air deflector shown in FIG. 11.
Figure 13:
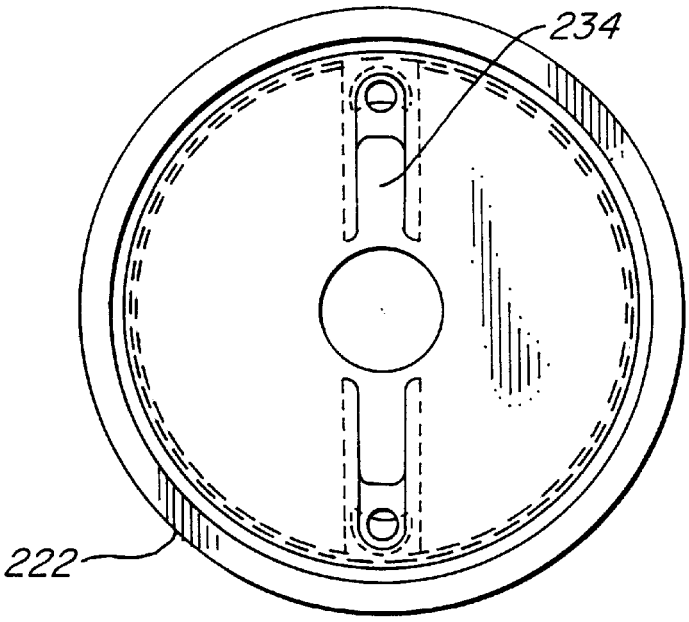
FIG. 13 is a rear view of the air deflector shown in FIG. 11.

FIG. 10 shows an embodiment of a spray nozzle assembly 210 having a stepped-down static mixer 212 and a manifold 214 with a downstream end 216 which includes a radially projecting deflector support 218. More particularly, the static mixer 212 has a first mixing section 220 with a first inner diameter and a first segment length, and a downstream second mixing section 221 with a second, smaller inner diameter and a second segment length, which may be the same as or different from the first segment length. A non-limiting example of this type of static mixer 212 has a first section with a ⅜ inch diameter and a 24 or 32 blade element, and a second section with a ¼ inch diameter and a 6 blade element. More than one step-down can be included. One of the important advantages in using a stepped-down static mixer is that a larger diameter mixing section is useful upstream with thicker or higher viscosity materials to provide adequate flow and minimize back pressure, and a smaller diameter mixing section can be used downstream to enable a single size of manifold to be used with different sizes of static mixers, all of which have the same diameter for the downstream section.

As is shown in FIGS. 10–13, the downstream end 216 of the manifold 214 is circular in cross section and is configured to receive by snap-fit an air deflector 222 which has a deflecting hood 224 around each of two diametrically spaced air outlets 236 to deflect the atomizing air inwardly toward the liquid stream discharging from the nozzle 238. The deflector support 218 of the manifold 214 has an annular groove 226 extending about its periphery in which is seated the annular rib 228 on the inner wall of the deflector 222 in order to hold the deflector in place while allowing it to rotate. Atomizing air enters the manifold 214 through the air inlet passage 230 and travels downstream through annular channel 232 to radially extending air channels 234 and then after travelling outwardly, moves through axially extending air channels 235 and exits through air outlets 236 spaced axially outwardly from the tip of the liquid dispensing nozzle 238. The hoods 224 on the deflector 222 deflect the air inwardly to promote atomization of the liquid in a linear spray pattern.

Although a threaded coupling nut has been shown to assembly the spray nozzle assembly to the dual cartridge, other types of couplings can be used depending upon the cartridges, such as bayonet couplings and snap fittings.

Generally, the conduit portion of the manifold has a threaded end portion for coupling to the air supply hose. However, other types of couplings may also be employed including bayonet couplings and snap together fittings.

In using the spray nozzle assembly of the present invention, it is generally preferable to pre-assemble at the factory the static mixer, manifold and coupling nut. A dual cartridge unit is inserted into the spray gun and the spray nozzle assembly is coupled to the dual cartridge by the coupling nut. The air supply tube is connected to the conduit, and the operator can then proceed. For optimum action, the air discharge should precede the movement of the pistons, and continue for a short period after termination of discharge of the components.

After the contents of the dual cartridges have been sprayed, or so much is necessary for the operation, the operator can readily disassemble the air supply hose from the manifold and the entire spray nozzle assembly from the cartridge, and discard it and the cartridge.

The spray nozzle assembly of the present invention is particularly useful in dispensing highly reactive two-component adhesives, sealants and coatings, including but not limited to polyureas, polyaspartics, epoxies, acrylics, silicones, polyesters, polyurethanes, polyurethane foams, and other fast curing compounds. Discharge lines 75 and 76 are designed to deliver the appropriate ratio of reactants. Solids, such as traction control agents, fillers, microballoons and other compounding components can be dispersed in one or both of the liquid reactants. The assembly preferably is used with a low pressure spray system.

Small diameter static mixers are used for low viscosity spray applied dual component materials. Larger diameter, up to and including 16 mm or ⅝ inch diameters can be used for thicker, more viscous compounds and formulations.

By using the pre-assembled, disposable spray nozzle assembly of the present invention for spraying highly reactive multi-component liquid systems, the steps of disassembling and cleaning components with solvent is eliminated, and the amount of down time required to replace a spent cartridge assembly is significantly reduced.

Having thus described the invention, what is claimed is:

1. A disposable spray nozzle assembly for coupling to a dual cartridge to mix and spray a dual component mixture comprising:

(a) a synthetic resin static mixer including (i) an elongated mixing tube with an inlet end portion and an outlet end portion providing a liquid dispensing nozzle having an outer wall, and (ii) a mixing element disposed in said mixing tube; and (b) a unitary synthetic resin manifold having a body portion with upstream end portion, a downstream end portion, and a longitudinal passage therethrough bounded by an inner wall, said upstream end portion extending about and being coupled to said mixer, said passage having a mixer support section extending about said mixer, an intermediate air inlet section, and an air dispensing section at the downstream end portion extending about and spaced from said dispensing nozzle at said outlet end portion of said mixing tube, said manifold including a tubular conduit portion extending outwardly from said body portion and providing a passage into said air inlet section of said passage, said outer wall of said mixer nozzle being spaced from said inner wall of said manifold to provide an air passage extending to the downstream end of said manifold.

2. The disposable spray nozzle assembly in accordance with claim 1 wherein said conduit portion is configured for attachment to air supply means.

3. The disposable spray nozzle assembly in accordance with claim 1 wherein there is included air deflection means mounted on said downstream end of said manifold to direct the air flow and discharged mixture.

4. The disposable spray nozzle assembly in accordance with claim 1 wherein said inlet end portion of said mixer provides a mixing chamber with first and second liquid inlets for receiving first and second liquid reactants from an associated dual cartridge.

5. The disposable spray nozzle assembly in accordance with claim 1 wherein said assembly includes coupling means for coupling said spray nozzle assembly to a dual cartridge.

6. The disposable spray nozzle assembly in accordance with claim 5 wherein said inlet end of said mixing tube is threaded to provide said coupling means for connection to a dual cartridge.

7. The disposable spray nozzle assembly in accordance with claim 1 wherein said mixer support section of said inner wall includes a plurality of peripherally extending ribs providing fluid sealing engagement about said static mixer.

8. The disposable spray nozzle assembly in accordance with claim 1 wherein said mixer support section is bonded to said mixer.

9. The disposable spray nozzle assembly in accordance with claim 3 wherein said air deflection means provides a plurality of air dispensing apertures.

10. The disposable spray nozzle assembly in accordance with claim 3 wherein said air deflection means is rotatably mounted on said manifold.

11. The disposable spray nozzle assembly in accordance with claim 1 wherein said air dispensing nozzle includes means for atomizing said liquid mixture in a circular spray pattern.

12. The disposable spray nozzle assembly in accordance with claim 3 wherein said air deflection means has first and second air dispensing apertures configured for atomizing said liquid mixture in a linear spray pattern.

13. The disposable spray nozzle assembly in accordance with claim 4 further including a twin cartridge connected to said first and second liquid inlets for dispensing first and second liquid reactants into said mixing chamber.

14. The disposable spray nozzle assembly in accordance with claim 13 wherein said twin cartridge has an outlet comprising a partitioned tubular projection.

15. The disposable spray nozzle assembly in accordance with claim 14 wherein said outlet is coupled to said mixer by a threaded coupling.

16. A disposable spray nozzle assembly for coupling to a dual cartridge to mix and spray a dual component mixture comprising:

(a) a synthetic resin static mixer including (i) an elongated mixing tube with an inlet end portion and an outlet end portion providing a liquid dispensing nozzle having an outer wall, and (ii) a mixing element disposed in said mixing tube;

(b) a unitary synthetic resin manifold having a body portion with upstream end portion, a downstream end portion, and a longitudinal passage therethrough bounded by an inner wall, said upstream end portion extending about and being coupled to said mixer, said passage having a mixer support section extending about said mixer, an intermediate air inlet section, and an air dispensing section at the downstream end portion extending about and spaced from said dispensing nozzle at said outlet end portion of said mixing tube, said manifold including a tubular conduit portion extending outwardly from said body portion and providing a passage into said air inlet section of said passage, said conduit portion being configured for attachment to air supply means, said outer wall of said mixer nozzle being spaced from said inner wall of said manifold to provide an air passage extending to the downstream end of said manifold; and (c) a twin cartridge connected to said first and second liquid inlets for dispensing first and second liquid reactants, said inlet end portion of said mixer providing a mixing chamber with first and second liquid inlets for receiving first and second liquid reactants from said dual cartridge.

17. The disposable spray nozzle assembly in accordance with claim 16 wherein there is included air deflection means mounted on said downstream end of said manifold to direct the air flow and discharged mixture.

18. The disposable spray nozzle assembly in accordance with claim 16 wherein said twin cartridge has an outlet comprising a partitioned tubular projection.

19. The disposable spray nozzle assembly in accordance with claim 18 wherein said outlet is coupled to said mixer by a threaded coupling.

20. The disposable spray nozzle assembly in accordance with claim 17 wherein said air deflection means is rotatably mounted on said manifold.

* * * * *